US009779718B2

(12) United States Patent
Gether et al.

(10) Patent No.: US 9,779,718 B2
(45) Date of Patent: Oct. 3, 2017

(54) CONTROL CIRCUIT FOR ACTIVE NOISE CONTROL AND METHOD FOR ACTIVE NOISE CONTROL

(71) Applicant: ams AG, Unterpremstaetten (AT)

(72) Inventors: Horst Gether, Bad Gleichenberg (AT); Martin Schoerkmaier, Graz (AT)

(73) Assignee: ams AG, Unterpremstaetten (AT)

( * ) Notice: Subject to any disclaimer, the term of this patent is extended or adjusted under 35 U.S.C. 154(b) by 0 days.

(21) Appl. No.: 15/129,818

(22) PCT Filed: Feb. 18, 2015

(86) PCT No.: PCT/EP2015/053413
§ 371 (c)(1),
(2) Date: Sep. 27, 2016

(87) PCT Pub. No.: WO2015/144360
PCT Pub. Date: Oct. 1, 2015

(65) Prior Publication Data

US 2017/0140746 A1 May 18, 2017

(30) Foreign Application Priority Data

Mar. 28, 2014 (EP) ..... 14162336

(51) Int. Cl.
*G10K 11/16* (2006.01)
*G10K 11/178* (2006.01)

(52) U.S. Cl.
CPC .. *G10K 11/1782* (2013.01); *G10K 2210/3016* (2013.01); *G10K 2210/3028* (2013.01); *G10K 2210/30232* (2013.01)

(58) Field of Classification Search
CPC ..... G10K 11/1784; G10K 11/16; G10K 2210/1081; G10K 2210/3056; G10K 2210/3018; H04R 1/1083; H04R 2460/01; H04R 5/003
USPC ..... 381/71.11, 71.6, 71.8, 71.12, 74
See application file for complete search history.

(56) References Cited

U.S. PATENT DOCUMENTS

| | | | | |
|---|---|---|---|---|
| 8,515,089 | B2 * | 8/2013 | Nicholson | G10K 11/1782 381/71.6 |
| 2011/0299695 | A1 | 12/2011 | Nicholson | |
| 2014/0051483 | A1 | 2/2014 | Schoerkmaier | |
| 2014/0086425 | A1 * | 3/2014 | Jensen | G10K 11/1784 381/71.11 |

* cited by examiner

*Primary Examiner* — Melur Ramakrishnaiah
(74) *Attorney, Agent, or Firm* — McDermott Will & Emery LLP

(57) ABSTRACT

We disclose a control circuit for active noise control, ANC, coupled to a speaker generating a speaker signal based on an amplified audio signal and to an ANC microphone generating a disturbed audio signal based on ambient noise and the speaker signal. The control circuit has a first mixer generating an intermediate audio signal by superposing an audio signal and a first compensation signal, a first amplifier generating the amplified audio signal based on the intermediate audio signal and a compensation unit generating a second compensation signal based on the audio signal. A tuning unit generates a compensated audio signal based on the disturbed audio signal and the second compensation signal. An ANC filter coupled to the tuning unit generates the first compensation signal by applying filter operations to the compensated audio signal.

17 Claims, 1 Drawing Sheet

CONTROL CIRCUIT FOR ACTIVE NOISE CONTROL AND METHOD FOR ACTIVE NOISE CONTROL

BACKGROUND OF THE INVENTION

The present disclosure relates to a control circuit for active noise control and to a method for active noise control for sound reproduction devices, in particular for headphones.

In sound reproduction devices, as for example headphones, active noise control, ANC, can be implemented. The goal of ANC is to reduce or remove unwanted external noise from the sound impression of a user. To this end, a microphone is situated at or inside the sound reproduction device recording sound corresponding to the sound or music received by the user including noise or other unwanted external sounds. For ANC the sound received by the microphone is evaluated and a correction signal is produced in order to minimize the effect of the environmental noise or other disturbing sounds.

However, in existing solutions for ANC the incorporation of the correction signal may lead to negative effects on the sound or music quality received by the user.

SUMMARY OF THE INVENTION

The present disclosure provides an improved concept for ANC to minimize unwanted effects on audio signals to be reproduced.

According to the improved concept, in addition to the above mentioned correction signal, a further correction signal is generated on the basis of an audio input signal. The further correction signal is then used within an ANC arrangement to reduce unwanted effects due to the processing of the audio input signal. In this way an improved sound reproduction, for example in a certain frequency range, in particular in a low frequency range, is achieved.

According to an embodiment of a control circuit for ANC, according to the improved concept, the control circuit is designed to be coupled to a speaker and to an ANC microphone. The speaker generates a speaker signal on the basis of an amplified audio signal while the ANC microphone generates a disturbed audio signal on the basis of ambient noise and the speaker signal.

The control circuit comprises a first mixer that is configured to generate an intermediate audio signal by superposing an audio signal and a first compensation signal. The control circuit further comprises a first amplifier configured to generate the amplified audio signal based on the intermediate audio signal. The control circuit further comprises a compensation unit, for example implemented as a filter network. The compensation unit is configured to generate a second compensation signal based on the audio signal. To this end the compensation unit applies filter operations to the audio signal.

A tuning unit is coupled to the ANC microphone and to the compensation unit. The tuning unit is configured to generate a compensated audio signal on the basis of the disturbed audio signal and the second compensation signal. Finally, the control circuit comprises an ANC filter configured to generate the first compensation signal by applying filter operations to the compensated audio signal.

The ANC microphone may be for example a digital microphone, a dynamic microphone, a condenser microphone, an electret microphone, a piezo microphone or another type of microphone.

The speaker signal corresponds to the sound the user actually is intended to hear. However, the ambient noise representing for example environmental noise or other unwanted external sounds, superimposes the speaker signal, which finally results in the disturbed audio signal. The disturbed audio signal corresponds approximately to the sound the user would actually hear without ANC. The tuning unit uses the second compensation signal in order to reduce, or in an ideal case totally remove, residues of the audio signal from the disturbed audio signal. That means that, in an ideal case, the compensated audio signal contains only information about the processed ambient noise but not about the processed audio signal.

To this end, the compensation unit emulates the information about the processed audio signal contained within the disturbed audio signal. In addition, a phase delay may be added during the generation of the second compensation signal to account for the fact that there is a time delay between the disturbed audio signal and the second compensation signal arriving at the tuning unit.

Then, the ANC filter applies filter operations to the compensated audio signal. The result is the first compensation signal being superposed with the audio signal by the first mixer to account for example for environmental noises and to reduce, or in an ideal case cancel, the effect of the ambient noise. The filter operations applied by the ANC filter may for example also account for details of the sound transmission from the speaker to the ear of a user and differences to the sound transmission from the speaker to the ANC microphone, respectively. In particular, a spatial arrangement of the speaker with respect to the ANC microphone on one hand and with respect to the ear on the other hand may be incorporated by the ANC filter. Such aspects may for example be relevant in view of spatial variations of the superposition of the speaker signal and the ambient noise.

The first mixer may for example be implemented as an adder essentially adding the first compensation signal to the audio signal. In such case, the filter operations applied by the ANC filter to the compensated audio signal comprise for example an effective inversion. Alternatively, the first mixer may for example be implemented as a subtractor, as an adder-subtractor or as an adder with one inverted and one non-inverted input.

In implementations of the control circuit, the filter operations applied to the audio signal by the compensation unit implement a transfer function. The transfer function characterizes effects on a signal due to at least one of the following: the first amplifier, the speaker, the ANC microphone and a sound transmission from the speaker to the ANC microphone.

The intention herefore is for example to emulate the information about the processed and/or transmitted audio signal contained in the disturbed audio signal. However, the generation of the second compensation signal is not affected by the ambient noise.

The transfer function implemented by the compensation unit may for example be determined during the production and/or calibration of the control circuit and/or the sound reproducing device. To this end, for example, a test signal may be compared with a signal resulting from the test signal being accordingly processed by the respective components. The determination of the transfer function may for example also comprise modelling of sound transmission in the sound reproducing device.

In some implementations of the control circuit, the tuning unit comprises a second mixer. The second mixer is configured to generate an intermediate noise signal by superposing the second compensation signal and a signal based on the disturbed audio signal. In particular, the second mixer is configured to subtract the second compensation signal from the signal based on the disturbed audio signal. The tuning unit is configured to generate the compensated audio signal on the basis of the intermediate noise signal.

The second mixer may for example be implemented as a subtractor, as an adder-subtractor or as an adder with one inverted and one non-inverted input. Alternatively, the second mixer may be implemented as an adder. In such case, the filter operations applied to the audio signal by the compensation unit comprise for example an effective inversion.

In further implementations of the control circuit, the tuning unit comprises a second amplifier in addition to the second mixer. In such embodiment, the second amplifier is configured to generate an adjusted disturbed audio signal on the basis of the disturbed audio signal. The second mixer is configured to generate an intermediate noise signal by superposing the adjusted disturbed audio signal and the second compensation signal, in particular by subtracting the second compensation signal from the adjusted disturbed audio signal.

Preferably, the gain factor of the second amplifier is tuneable, for example tuneable during production and/or calibration of the control circuit and/or the sound reproducing device. For example, the second amplifier is used to compensate tolerances of for example the speaker and/or the ANC microphone. Commonly, respective tolerances lie, for example, in the order of several decibels, for example in the order of 1 db-10 db or around 3 db. In order to improve the performance of noise reduction, the disturbed audio signal is adjusted accordingly to the second compensation signal by the second amplifier. Furthermore, the second amplifier may, for example, be used to control the general performance level of noise reduction in the control circuit.

In further implementations of the control circuit, the tuning unit further comprises a third amplifier configured to generate the compensated audio signal by amplification or attenuation of the intermediate noise signal.

Such implementation has the advantage that the adjustment of the adjusted disturbed audio signal to the second compensation signal can be performed independently from the control of the general level of noise reduction performance. The second amplifier is then for example used to compensate tolerances of the speaker and/or the ANC microphone. The third amplifier is then used to tune the level of noise reduction performance.

In further implementations of the control circuit wherein the tuning unit comprises the third amplifier the amplification or attenuation of the intermediate noise signal by the third amplifier can be changed by a user during operation.

In further implementations of the control circuit, the tuning unit comprises a test terminal to provide the intermediate noise signal to an external readout device. In implementations where the tuning unit comprises the third amplifier, the test terminal is preferably located between the second mixer and the third amplifier.

The test terminal and the external readout device can, for example, be used for an accurate compensation of microphone and/or speaker tolerances. For example, this may be performed during production or calibration of the control circuit and/or the sound reproduction device.

According to a further implementation of the control circuit, the compensation unit generates the second compensation signal utilizing a delay element.

In particular, the delay element may add a phase delay to account for the time delay between the disturbed audio signal and the second compensation signal when arriving at the tuning unit.

For example, the delay element may add only a first part of the phase delay, while the second part of the phase delay is then added by other components of the compensation unit. Alternatively, the other components of the compensation unit add the first part of the phase delay and then the delay element adds the second part of the phase delay.

In some implementations of the control circuit, the delay element comprises an all-pass filter.

According to the improved concept, also a method for ANC for a sound reproduction device with a speaker and an ANC microphone can be provided. Thereby, the speaker generates a speaker signal based on an amplified audio signal and the ANC microphone generates a disturbed audio signal based on the speaker signal and ambient noise. In an embodiment, according to the improved concept, the method comprises generating an intermediate audio signal by superposing an audio signal and a first compensation signal. Furthermore, the method comprises generating the amplified audio signal by amplifying the intermediate audio signal. A second compensation signal is generated by applying filter operations to the audio signal. Then, a compensated audio signal is generated on the basis of the second compensation signal and the disturbed audio signal. Finally, the first compensation signal is generated by applying filter operations to the compensated audio signal.

Preferably, the generation of the compensated audio signal on the basis of the second compensation signal and the disturbed audio signal is performed by subtraction of the second compensation signal from a signal based on the disturbed audio signal.

In some implementations of the method, the application of filter operations to the audio signal is performed implementing a transfer function. The transfer function characterizes effects on a signal due to at least one of the following: the first amplifier, the speaker, the ANC microphone and a sound transmission from the speaker to the ANC microphone.

In further implementations of the method, the generation of the compensated audio signal comprises generating an adjusted disturbed audio signal by amplification or attenuation of the disturbed audio signal. In such embodiment, the method further comprises the generation of an intermediate noise signal by superposing the second compensation signal and the adjusted disturbed audio signal, preferably by subtracting the second compensation signal from the adjusted disturbed audio signal. The generation of the second compensation signal is then performed on the basis of the intermediate noise signal.

In further implementations of the method, the generation of the compensated audio signal further comprises an amplification or attenuation of the intermediate noise signal.

In further implementations of the method, the amplification or attenuation of the intermediate noise can be performed at least partly by a user during operation.

Other implementations of the method comprise providing the intermediate noise signal to an external readout device.

Further implementations of the method may be readily derived from the various embodiments of the control circuit described above.

BRIEF DESCRIPTION OF THE DRAWINGS

In the following, the improved concept is explained in detail with the aid of exemplary embodiments by reference to the drawings. Components that are functionally identical or have an identical effect are denoted by identical references. Identical or effectively identical components may be described only with respect to the figure where they occur first, their description is not necessarily repeated in successive figures.

DETAILED DESCRIPTION

Figure 1:
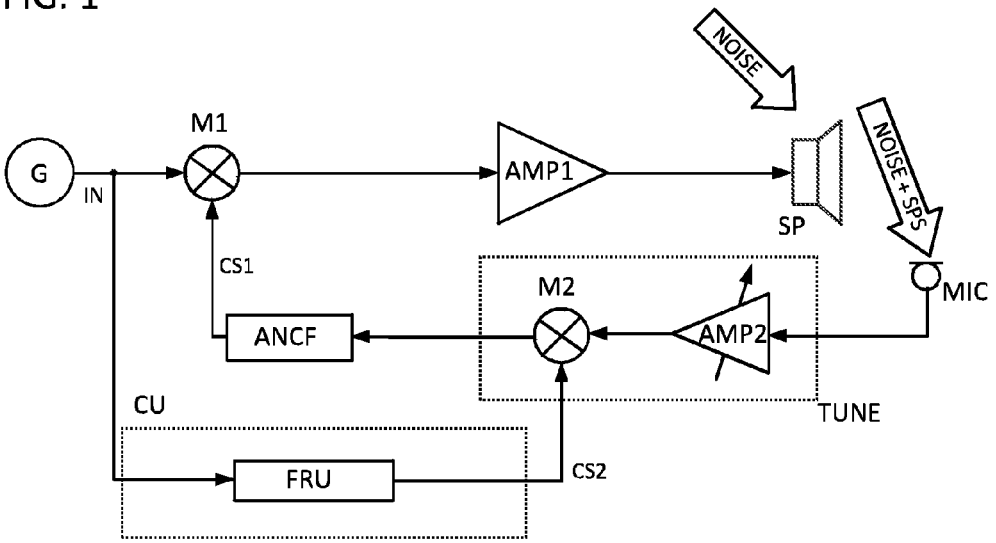
FIG. 1 shows an exemplary embodiment of a control circuit for ANC according to the improved concept.

FIG. 1 shows an exemplary embodiment of a control circuit for ANC according to the improved concept. The control circuit comprises a first mixer M1 and a first amplifier AMP1 that is connected to the first mixer M1. Furthermore, the first amplifier AMP1 is coupled to a speaker SP that is for example part of a sound reproducing device, for example of a headphone. The sound reproducing device also comprises an ANC microphone MIC positioned at a location with respect to the speaker SP that allows detecting a sound similar to the sound heard by a user. The control circuit comprises a tuning unit TUNE with a second amplifier AMP2 coupled to the ANC microphone MIC and a second mixer M2 connected to the second amplifier AMP2. The control circuit further comprises an ANC filter ANCF coupled between the first mixer M1 and the second mixer M2. Finally, the control circuit comprises a compensation unit CU, in the shown embodiment represented by a frequency compensation unit FRU. The frequency compensation unit FRU is for example implemented as a filter network. Finally, an generating device G is coupled to the compensation unit CU and to the first mixer M1.

The ANC microphone may be for example a digital microphone, a dynamic microphone, a condenser microphone, an electret microphone, a piezo microphone or another type of microphone.

In different implementations, the first mixer may for example be designed as an adder, as a subtractor, as an adder-subtractor or as an adder with one inverted and one non-inverted input.

The control circuit receives an audio signal IN from a generating device G. The audio signal IN represents in a sense a raw signal to be processed and finally used to generate sound by the speaker SP. The audio signal IN is fed in parallel to the first mixer M1 and to the frequency compensation unit FRU. The first mixer M1 superposes the audio signal IN with a first compensation signal CS1 to output an intermediate audio signal to the first amplifier AMP1. Herein, the first compensation signal CS1 is for example conditioned such that the resulting intermediate audio signal in a sense contains inversed information about external disturbances for example environmental noise, as described later. The intermediate audio signal is then for example amplified by the first amplifier AMP1 resulting in an amplified audio signal according to general requirements and/or settings of the sound reproduction.

The amplified audio signal is processed by the speaker SP generating a speaker signal SPS. The speaker signal SPS is, for example, an actual superposition of sound waves propagating for example through air to reach an ear of a user. However, commonly there exist environmental noises or other disturbing external sounds represented by ambient noise NOISE. The ambient noise NOISE superimposes the speaker signal SPS and the sound actually reaching the ear of the user is a superposition of the ambient noise NOISE and the speaker signal SPS or a certain spatial part of the superposition, respectively.

A different superposition, or a different spatial part of the superposition, respectively, of the ambient noise NOISE and the speaker signal SPS is detected by the ANC microphone MIC which based thereupon generates a disturbed audio signal. The disturbed audio signal is fed to the second amplifier AMP2. The second amplifier AMP2 is tuneable in that its gain factor can be adjusted. The second amplifier AMP2 amplifies or attenuates the disturbed audio signal to generate an adjusted disturbed audio signal that is provided to the second mixer M2. The second mixer also receives the second compensation signal CS2 from the frequency compensation unit FRU and superimposes both, in particular subtracts the second compensation signal CS2 from the adjusted disturbed audio signal. The result of the superposition is the compensated audio signal which is fed to the ANC filter ANCF.

The second mixer is preferably implemented as a subtractor but may also be designed as an adder, as an adder-subtractor or as an adder with one inverted and one non-inverted input.

The second compensation signal CS2 is generated by the frequency compensation unit FRU by adaption of the audio signal IN. To this end, the frequency compensation unit FRU applies filter operations to the audio signal IN that implement a transfer function. The transfer function characterizes the modifications of a signal due to signal processing and/or sound transmission. In particular, the transfer function characterizes effects on a signal due to at least one of the following: the first amplifier AMP1, the speaker SP, the ANC microphone MIC and a sound transmission from the speaker SP to the ANC microphone MIC. As a result, the second compensation signal may for example emulate the information about the processed audio signal contained within the disturbed audio signal. Furthermore, the frequency compensation unit FRU adds a phase delay with respect to the disturbed audio signal. The latter may be necessary to account for the fact that there may be a time delay between the disturbed audio signal and the second compensation signal CS2 arriving at the tuning unit TUNE.

For example, subtracting the second compensation signal from the adjusted disturbed audio signal by the second mixer M2 then reduces, or in an ideal case totally removes, residues of the audio signal IN from the disturbed audio signal. In an ideal case, the compensated audio signal contains only information about the processed ambient noise NOISE but not about the processed audio signal IN.

In case the second mixer M2 is implemented as an adder, for example the frequency compensation unit FRU accordingly may take over an effective inversion of the audio signal. An addition of the second compensation signal CS2 to the adjusted disturbed audio signal corresponds then to the subtraction of the second compensation signal CS2 from the adjusted disturbed audio signal.

The amplification or attenuation of the disturbed audio signal by the second amplifier AMP2 may serve for at least two potential purposes in the embodiment of FIG. 1. Firstly, it may provide a means to control the general performance level of noise reduction in the control circuit. For this purpose, a gain factor of the second amplifier AMP2 may for example also be changed during operation of the sound reproduction device. Secondly, the second amplifier AMP2 may be used to compensate tolerances for example of the speaker SP and/or the ANC microphone MIC. Commonly, respective tolerances lie, for example, in the order of several decibels, for example in the order of 1 db-10 db or around 3 db. Therefore, it may be favourable to adjust the disturbed audio signal to the second compensation signal CS2 to reduce or to minimize residues of the audio signal IN in the compensated audio signal. In general, a tuning of the gain factor of the second amplifier AMP2 may be for example performed during production and/or calibration of the control circuit and/or the sound reproducing device.

The compensated audio signal is then further processed by the ANC filter ANCF to generate the first compensation signal CS1. To this end, the ANC filter applies filter operations to the compensated audio signal. For example, a certain frequency range of the compensated audio signal may be suppressed. An adjustment of the amplitudes and/or phases of the compensated audio signal by the ANC filter ANCF is performed such that the resulting intermediate audio signal in a sense contains inversed information about external disturbances for example environmental noise. The first mixer M1 generating the intermediate audio signal may for example be implemented as an adder. In such case, the filter operations applied by the ANC filter to the compensated audio signal comprise for example an effective inversion. Alternatively, the first mixer may for example be implemented as a subtractor, as an adder-subtractor or as an adder with one inverted and one non-inverted input.

Figure 2:
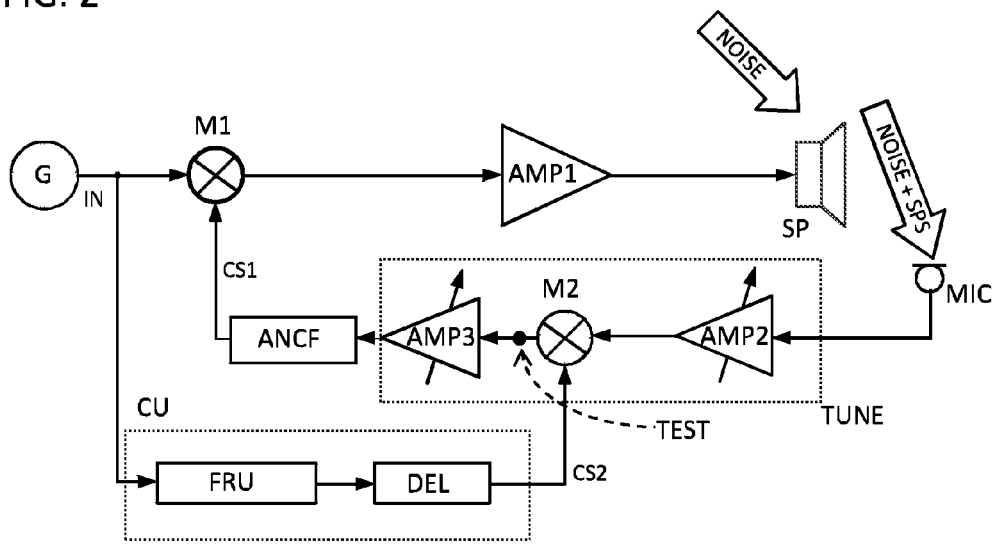
FIG. 2 shows a further exemplary embodiment of a control circuit for ANC according to the improved concept.

FIG. 2 shows a further exemplary embodiment of a control circuit for ANC according to the improved concept which is based on the embodiment of FIG. 1. The embodiment shown in FIG. 2 differs from the one shown in FIG. 1 by a third amplifier AMP3 comprised by the tuning unit TUNE and coupled between the ANC filter ANCF and the second mixer M2 and by a test terminal TEST between the third amplifier AMP3 and the second mixer M2. Furthermore, the compensation unit comprises a delay element DEL coupled between the frequency compensation unit FRU and the second mixer M2.

In the shown embodiment, the delay element DEL takes over, or partly takes over, from the frequency compensation unit FRU the addition of the phase delay to account for the time delay between the second compensation signal CS2 and the disturbed audio signal arriving at the tuning unit TUNE or the adjusted disturbed audio signal arriving at the second mixer, respectively. Accordingly, the frequency compensation unit FRU adds only a part of the delay phase while the delay element DEL adds the remaining part of the delay phase, or the frequency compensation unit FRU does not add any part of the phase delay while the delay element DEL adds the total phase delay. The order of the delay element DEL and the frequency compensation unit FRU can, for example, also be opposite to the order shown in FIG. 2.

The third amplifier AMP3 and the second amplifier AMP2 together allow for an independent control of the general performance level of ANC in the control circuit and the compensation of tolerances for example of the speaker SP and/or the ANC microphone MIC. For example, the second amplifier AMP2 may be used to compensate tolerances for example, of the speaker SP and/or the ANC microphone MIC. Then, the third amplifier AMP3 may be used to control the general performance level of noise reduction. For example, the third amplifier AMP3 may be designed such that a gain factor of the third amplifier AMP3 may be changed during operation of the sound reproduction device. For example, the third amplifier AMP3 may be included in the ANC filter ANCF instead of being part of the tuning unit TUNE. It may also be favourable to interchange the functions of the second amplifier AMP2 and the third amplifier AMP3.

The test terminal TEST allows for an external readout device to be coupled to the control circuit. This may be advantageous for exact compensation of the above mentioned tolerances for example during production and/or calibration of the control circuit and/or the sound reproduction device.

Naturally, other embodiments of the control circuit are obtained based on the embodiment shown in FIG. 1 by including not all three but only one or two of the additional components of the embodiment shown in FIG. 2, namely the delay element DEL, the third amplifier AMP3 and the test terminal TEST.

Further, it is pointed out that all filter components that are comprised by an embodiment of the control circuit or by components of the control circuit may be implemented as analog filters, as digital filters or even be based on passive elements. This applies in particular to the ANC filter ANCF and the compensation unit CU and their components.

The embodiments of the control circuit and the methods for ANC presented herein may also be combined or split in order to meet specific requirements.

The control circuit may, for example, be built in the sound reproducing device, for example in an earpad or another component of a headphone. Another possibility is that the control circuit is built in the generating device G. The generating device G may for example correspond to an electronic device, such as a mobile phone, a telephone, a television, a portable or stationary music player or a walkie-talkie.

A control circuit according to the improved concept may, for example, be implemented in an integrated circuit. The integrated circuit may include also additional circuits for example for power management.

A control circuit according to the improved concept can, for example, also be realized by adding parts of the described control circuit, particularly including the compensation unit, to another ANC arrangement.

The invention claimed is:

1. A control circuit for active noise control, ANC, to be coupled to a speaker generating a speaker signal on the basis of an amplified audio signal and to an ANC microphone generating a disturbed audio signal on the basis of ambient noise and the speaker signal, the control circuit comprising
   - a first mixer configured to generate an intermediate audio signal by superposing an audio signal and a first compensation signal;
   - a first amplifier configured to generate the amplified audio signal based on the intermediate audio signal;
   - a compensation unit configured to generate a second compensation signal by applying filter operations to the audio signal;
   - a tuning unit configured to generate a compensated audio signal on the basis of the disturbed audio signal and the second compensation signal;
   - an ANC filter configured to generate the first compensation signal by applying filter operations to the compensated audio signal.

2. The control circuit according to claim 1, wherein the filter operations applied to the audio signal by the compensation unit implement a transfer function characterizing effects on a signal due to at least one of the following: the first amplifier, the speaker, the ANC microphone and a sound transmission from the speaker to the ANC microphone.

3. The control circuit according to claim 1, wherein
   - the tuning unit comprises a second mixer configured to generate an intermediate noise signal by subtracting the second compensation signal from a signal based on the disturbed audio signal; and the tuning unit is configured to generate the compensated audio signal on the basis of the intermediate noise signal.

4. The control circuit according to claim 3, wherein the tuning unit further comprises a second amplifier configured to generate an adjusted disturbed audio signal on the basis of the disturbed audio signal; and the second mixer generates the intermediate noise signal by subtracting the second compensation signal from the adjusted disturbed audio signal.

5. The control circuit according to claim 3, wherein the tuning unit further comprises a third amplifier configured to generate the compensated audio signal by amplification or attenuation of the intermediate noise signal.

6. The control circuit according to claim 5, wherein an extent of the amplification or attenuation of the intermediate noise signal can be changed by a user during operation.

7. The control circuit according to claim 3, wherein the tuning unit comprises a test terminal to provide the intermediate noise signal to an external readout device.

8. The control circuit according to claim 1, wherein the compensation unit generates the second compensation signal utilizing a delay element.

9. The control circuit according to claim 8, wherein the delay element comprises an all-pass filter.

10. A method for active noise control, ANC, for a sound reproduction device with a speaker generating a speaker signal based on an amplified audio signal and with an ANC microphone generating a disturbed audio signal based on the speaker signal and ambient noise, wherein the method comprises generating an intermediate audio signal by superposing an audio signal and a first compensation signal;

generating the amplified audio signal by amplifying the intermediate audio signal;

generating a second compensation signal by applying filter operations to the audio signal;

generating a compensated audio signal on the basis of the second compensation signal and the disturbed audio signal;

generating the first compensation signal by applying filter operations to the compensated audio signal.

11. The method according to claim 10, wherein the filter operations applied to the audio signal implement a transfer function characterizing effects on a signal due to at least one of the following: the amplification of the intermediate audio signal, the speaker, the ANC microphone and a sound transmission from the speaker to the ANC microphone.

12. The method according to claim 10, wherein the generation of the compensated audio signal comprises generating an adjusted disturbed audio signal by amplification or attenuation of the disturbed audio signal;

generating an intermediate noise signal by subtracting the second compensation signal from the adjusted disturbed audio signal; and generating the second compensation signal on the basis of the intermediate noise signal.

13. The method according to claim 12, wherein the generation of the compensated audio signal further comprises an amplification or attenuation of the intermediate noise signal.

14. The method according to claim 13, wherein the amplification or attenuation of the intermediate noise signal can be performed at least partly by a user during operation.

15. The method according to claim 12, wherein the method further comprises providing the intermediate noise signal to an external readout device.

16. The method according to claim 10, wherein the second compensation signal is generated utilizing a delay.

17. The method according to claim 16, wherein the delay is implemented with an all-pass filter.

* * * * *